United States Patent [19]

Thorgeirsson, deceased et al.

[11] Patent Number: 4,652,246

[45] Date of Patent: Mar. 24, 1987

[54] LIFE NET TO RESCUE MEN FROM SEA OR WATER ON BOARD A SHIP OR UPON A PIER

[76] Inventors: Markus B. Thorgeirsson, deceased, late of Hafnarfjordur; by Helena R. Magnusdottir, sole heir, Hvaleyrarbraut 7, both of 220 Hafnarfjordur, Iceland

[21] Appl. No.: 761,782

[22] Filed: Aug. 2, 1985

[30] Foreign Application Priority Data

Aug. 8, 1984 [DK] Denmark ..... 3827/84
Aug. 23, 1984 [IS] Iceland ..... 2937

[51] Int. Cl.[4] ..... B63C 9/00

[52] U.S. Cl. ..... 441/80; 441/84; 43/7

[58] Field of Search ..... 441/80, 81, 83–87; 43/7, 10, 14

[56] References Cited

U.S. PATENT DOCUMENTS 1,016,881 2/1912 Fox ..... 43/10
2,817,860 12/1957 Fritz ..... 441/83
3,165,853 1/1965 Ansell ..... 43/7

FOREIGN PATENT DOCUMENTS

WO84/03076 8/1984 PCT Int'l Appl. ..... 441/80
1241609 8/1971 United Kingdom ..... 441/80

*Primary Examiner*—Sherman D. Basinger
*Assistant Examiner*—Paul E. Salmon
*Attorney, Agent, or Firm*—Harvey B. Jacobson

[57] ABSTRACT

A rescue net structure for rescuing persons from the sea or other bodies of water is disclosed. The structure has a net with mesh openings which are larger than thigh size but smaller than chest size. The net is attached to side ropes which are provided with floats and the side ropes at a forward end of the structure are extended to form pulling ropes. A sinker rope extends between the side ropes at the rear end of the structure. The sinker rope has the effect of submerging the rear end of the structure in the water, and pulling together rear end portions of the side ropes while their front ends remain open. Thus a partial enclosure is formed into which a person to be rescued can enter and be enmeshed in the net in an upright position.

9 Claims, 3 Drawing Figures

FIG. 1
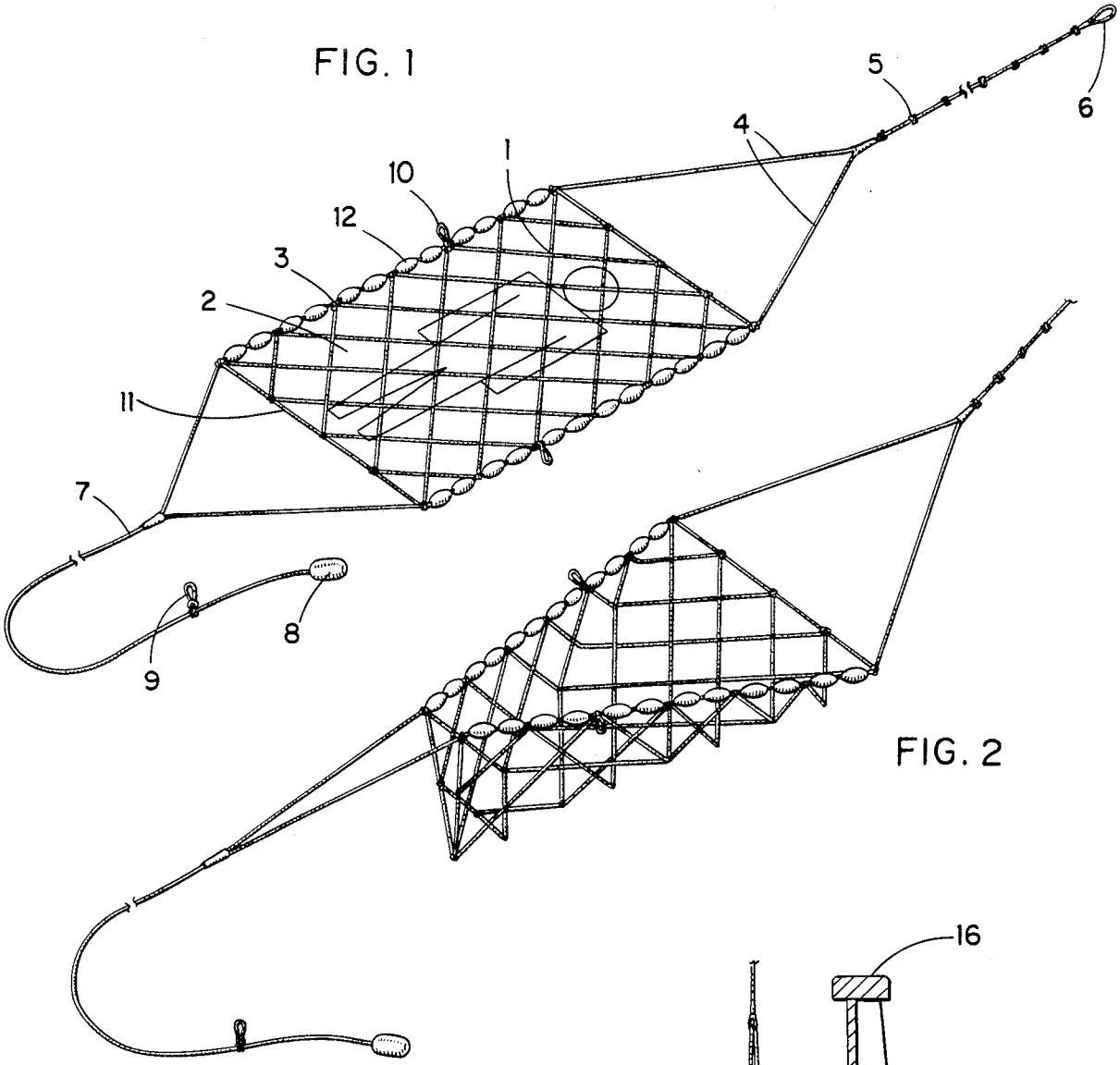
FIG. 2
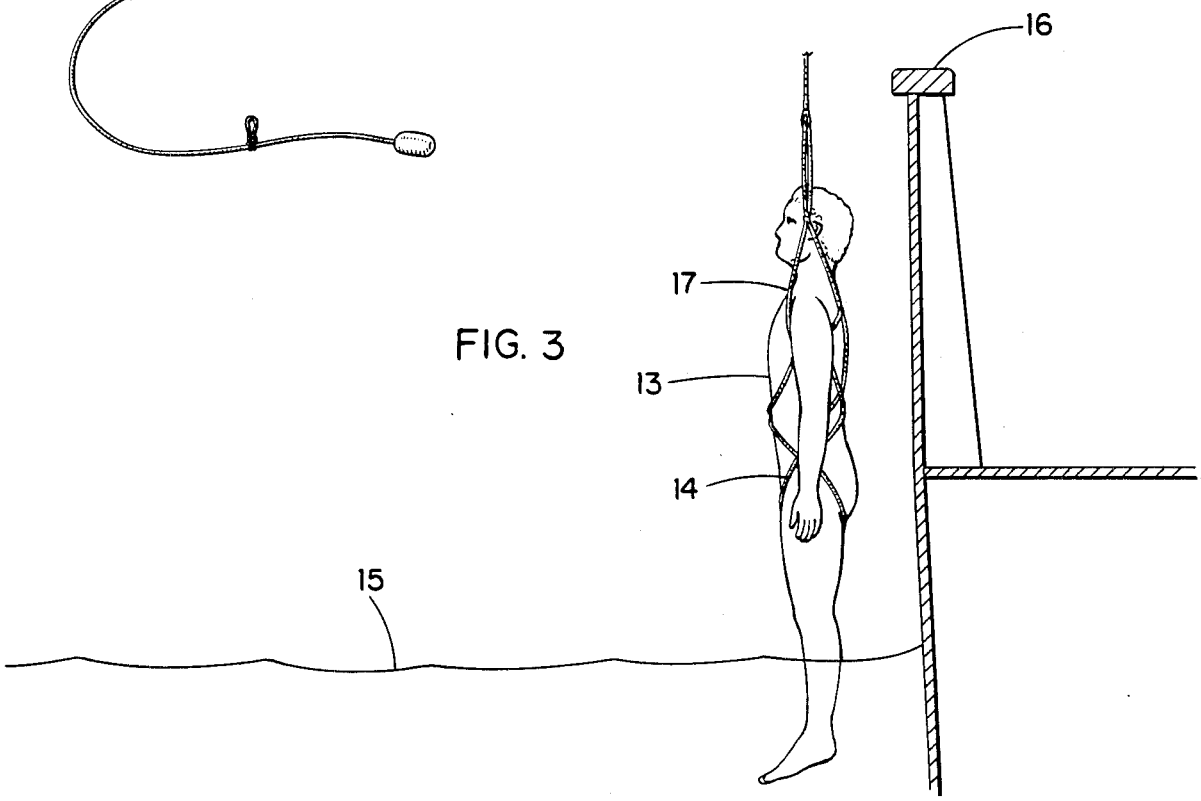
FIG. 3

LIFE NET TO RESCUE MEN FROM SEA OR WATER ON BOARD A SHIP OR UPON A PIER

BACKGROUND AND SUMMARY OF THE INVENTION

The life net consists of a net, for example 1.4 by 2.5 meters square with 300 mm to 500 mm meshes of trawl yarn, where the sides are connected into side ropes, connected to pulling ropes at front end and to a life line at the rear end and equipped with floats, whereas the rear end is equipped with leaded rope. The side ropes are furnished with openable locks, which can be locked into the net, locking the net around the body. When the net is pulled on board, the body will mesh into the net and can not get loose or fall from the net.

The end of the pulling rope is fastened on deck and the net is thrown over board to a man in the water, who crawls over the lead rope at the rear end. The net is pulled on board and arms and legs will thread into the meshes and the body will be secured into the net, which is pulled on board.

A rescuer locks the end of a 30 m life line at the rear end of the net around his waist, jumps over board and brings a helpless man into the net and locks it around the man and also around himself and then the net is pulled on board with both men, either by hand or by a capstan.

A life ring can float one man but by which the man can not be taken on board a ship. A fixed climbing net on the side of a ship is a passable way for healty and unexhausted men, but not for exhausted, cold or wounded ones.

A rescuing basket according to U.S. Pat. No. 2,557,079 has many drawbacks. The man must climb into the basket over a stiff floating girdle and upon a shallow net with small meshes, where he will not be meshed and is therefore vulnerable in a storm and heavy seas. The basket is difficult to manage up the side of the ship and the friction seeks to overturn it, esspecially in heavy sea. Therefore the basket must be suspended free and therefore needs a boom as shown in FIG. 1. Such a boom is a part of the device and the man can not be saved except he falls into the sea below the boom. If the boom is on the one board and the man in the sea on the other, the device will be of no use.

There is known a rolling net, a kind of an elastic lattice, from the norwegian company Dacon Sub Sea A/S, where the one side of the net is fixed within the gunwale and the other is pulled up with the man in the net rolling up the side of the ship. The lattice is a long one for high shipboards, the man will not be meshed and is loose and the device therefore unfit for use in heavy sea. The device is unable of being transported to the man, it is fixed to the gunwale and only made for life boats patrolling to a wounded man in calm sea and not intended for other use, for example not for usual ships.

It is usually only in storm and heavy sea, that men fall over board, ships sink and the rescue is difficult. A snowstorm, frost and darkness and a group of six men on a sinking raft at the side of the ship, black and slippery of oil, only 2 meters from gunwale, high wind and waves 12 meters high. Hopeless to go over board. No known rescuing devices would have been of help. A crew of 10 on a fishing vessel rescued four alive, but two were dead. This is a true report of a real accident.

Shivering and dying men, unable to understand the language of their rescuers can do absolutely nothing but fumble in confusion in the dark. It is sufficient for a rescue with a life net according to the invention.

Known rescuing devices aim at preventing the man in sinking but are less or not able to lift him in from sea or water on board a ship or upon a pier. Although that is an important part of the rescue, as cold is the most frequent cause of death and a cause of drowning, and the rescue is not finished until the man has been elevated from the water and has been brought inside from the cold. Under severe conditions nothing else will be of use than a rescuing device, which is so locked around the man, that he directly can not get loose from it, whatever is going on. The device must be designed to lift the man in on board a ship, and it must embrace the man almost automatically. It must be a kind of a trap, which catches the man, without hurting him. Such a device has not existed.

The invention is such a device, a life net, which meshes the man, traps him, where he can not get loose. Then the net with the man is elevated on board. In order to mesh the man into the net, its meshes must be of adequate size.

The meshing finds place, when the net is pulled. Then the meshes will be pulled upon the legs and arms of the man, especially the legs up to the pelvis, until the man is sitting in the net. The meshes will also be pulled upon the arms, balancing the body and preventing tumbling.

In order to mesh the man, the circumference of the mesh must be greater than the circumference of the thigh with clothes at the pelvis, but at the same time less than the circumference of his chest. As the circumference of the largest thigh is less than the smallest chest measure, the largest thigh can enter that mesh, which the smallest chest will not get through, and therefore the largest thigh and the smallest chest can be rescued with the same net, the biggest man and a child. The man will mesh around the tigh and the child around the chest.

BRIEF DESCRIPTION OF THE DRAWINGS

FIG. 1 is a perspective view of a rescue net structure in accordance with the invention laid out flat on land.

FIG. 2 is a perspective view of the structure submerged in water for receipt of the person to be rescued.

FIG. 3 is a side elevational view of the structure during a rescue operation.

DESCRIPTION OF THE PREFERRED EMBODIMENT

A life net according to the invention will now be described with following figures. FIG. 1 is an isometric view of the life net lying on a floor. The net 1 is made of meshes 2, which are for example 4 00 mm. On the sides the net is tied into the side ropes 3, in such a way that it can not slide along them. On the side ropes 3 there are the floats 12. At the front end of the side ropes they are connected to pulling ropes 4 with knots 5, loops 6 or such outfit for easier grip and hold, when pulling in of the net and for hooking a trawl wire into. At the rear end the side ropes are connected to a life line 7 with a float 8 on the end. At a distance of a chests circumference from the end there is an openable lock 9. A rescuer can bend the end around his chest and close the lock 9 around the line at the float 8. Thereby is formed a chest loop, which will not tighten into the chest of the rescuer.

On the side ropes 3 of the net there are openable locks 10, which can be locked into the net anywhere to lock the net around the chest or the waist. At the rear end of the net there is a lead rope 11, which sinks in water, sinking the rear end of the net 1, and pulls together the rear ends of the side ropes 3 as shown in FIG. 2. In that way there is formed a kind of a dock, which can easily be opened and entered by separating the ends, but will automatically then embrace the man. The rear end of the dock is submerged in the water and is therefore no hindrance to the man in crawling into the dock with his head ahead.

When the man has entered the dock, the pulling rope is pulled, and then the man will automatically be meshed, in such a way that the meshes of the net will be pulled upon his legs and arms. Also the man on the rescuer can lock the net around the waist or chest with the locks 10. After meshing, the man is elevated from the water as shown in FIG. 3, showing only those parts of the net, which are in contact with the mans body and mesh him. Arms and legs of the man are free and he can help in the rescue action and defend himself against threats in the water and on the way on board the ship.

FIG. 3 shows a man 13 being elevated up fron the water 15 up over the gunwale 16. The man's weight is resting in the meshes 14, which have been pulled upon his legs up to the pelvis, such that he is sitting in the net. The meshes 17 have been pulled upon his arms up to his chest and keep him balanced, so that he can not tumble over from the net. Thus he is perfectly meshed in the net and can not get loose whatever happens.

It is claimed:

1. A rescue net structure for rescueing a person from the sea or other body of water and elevating the person onto a ship or other object, the structure comprising a net fastened to side ropes, flotation means associated with the side ropes, pulling ropes extending from the respective side ropes at one end defining a forward end of the structure, the net including a foldable rear end sinker rope at the other end of the structure extending between rear end portions of the side ropes for submerging a rear end section of the net in water and pulling together the rear end portions of the side ropes at least partially closing the rear end section of the net while the front end section thereof remains open to form a partial enclosure for the person to be rescued to enter in an upright position and become enmeshed in the net.

2. The invention of claim 1 wherein the flotation means comprises individual floats spaced along the side ropes.

3. The invention of claim 1 wherein the sinker rope is a lead rope.

4. The invention of claim 1 wherein the net has mesh openings which are larger than the person's thigh size and smaller than the person's chest size.

5. The invention of claim 1 including hook means associated with the side ropes for fastening the structure around the person to be rescued.

6. The invention of claim 1 wherein the side ropes are extended rearwardly beyond said sinker rope and connected to a life line.

7. The invention of claim 6 wherein the life line has a free end provided with a float and hook means spaced from the free end for fastening the life line around a rescuer.

8. The invention of claim 1 wherein the pulling ropes are connected to a grip rope.

9. The invention of claim 8 including spaced knots formed along the grip rope.

* * * * *